United States Patent [19]

Kalaam et al.

[11] Patent Number: 4,959,876

[45] Date of Patent: Oct. 2, 1990

[54] FIREMAN'S COAT

[75] Inventors: Shaik M. Kalaam; Gary W. Hughson, both of Scarborough, Canada

[73] Assignee: Safeco Mfg. Limited, Scarborough, Canada

[21] Appl. No.: 434,304

[22] Filed: Nov. 13, 1989

[51] Int. Cl.[5] ..... A41D 1/02; A41D 13/00

[52] U.S. Cl. ..... 2/93; 2/81; 2/97

[58] Field of Search ..... 2/81, 85, 93, 97, 247, 2/252, 272, DIG. 6

[56] References Cited

U.S. PATENT DOCUMENTS

| | | | |
|---|---|---|---|
| 4,507,806 | 4/1985 | Coombs | 2/85 |
| 4,768,233 | 9/1988 | Grilliot et al. | 2/81 |
| 4,774,725 | 10/1988 | Page | 2/81 |
| 4,817,210 | 4/1989 | Aldridge et al. | 2/93 |

*Primary Examiner*—William A. Cuchlinski, Jr.
*Assistant Examiner*—Patrick R. Scanlon
*Attorney, Agent, or Firm*—Fetherstonhaugh & Co.

[57] ABSTRACT

A fireman's coat of the type which has an outer shell and a detachable liner for the outer shell and side pockets formed in opposite sides of the outer shell also has visible indicator patches on each side in close proximity to the open end of each pocket. The indicator patches have a sufficient extent to be clearly visible from the front, back and sides of the outer coat when the coat is worn by a fireman in use. A narrow opening is formed in each side of the outer shell in close proximity to the open end of each pocket. A pocket flap is attached to each side of the liner so that it can extend through one of the narrow openings formed in the sides of the outer shell. Velcro fasteners are provided for securing each pocket flap in an outwardly overlying relationship with respect to the outer shell to close the open end of its associated pocket and to overlie and obscure the visible indicator patches associated therewith to clearly indicate that the liner is located in the outer shell in use.

3 Claims, 3 Drawing Sheets

FIREMAN'S COAT

BACKGROUND OF THE INVENTION

Figure 2:
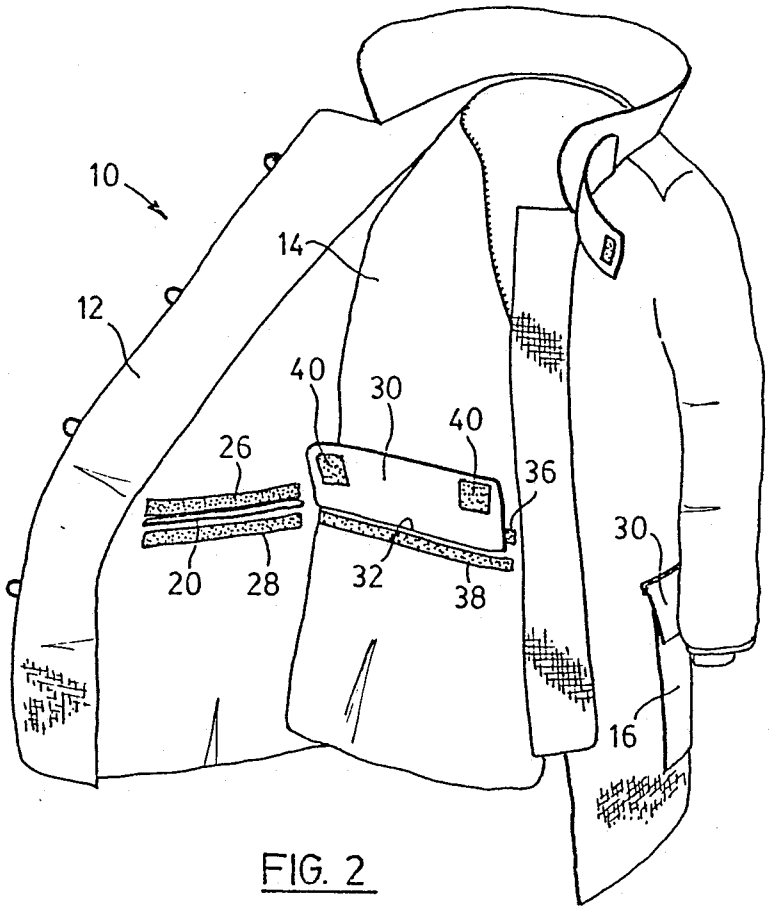

This invention relates to a fireman's coat.

In particular, this invention relates to a fireman's coat which has an outer shell and an inner liner and visible indicator means for indicating when the liner is removed from the outer shell.

U.S. Pat. No. 4,507,806 dated Apr. 2, 1985, Coombs, discloses a fireman's coat which has an inner liner and an outer. The inner liner has a collar which is clearly visible on the exterior of the outer shell when the inner liner is located in the outer shell. When the liner is removed, the collar is removed and thus when the garment is worn without the inner liner the absence of the inner liner can be clearly detected by the absence of the collar. Generally, however, a fireman's helmet is constructed with a lining which extends downwardly and serves to protect the back of the neck of the wearer. This lining can obscure the collar portion of the coat and in these circumstances, the markings of the Coombs garment may not be clearly visible from the back of the wearer.

U.S. Pat. No. 4,774,725 discloses an alternative construction in which a tab which is formed on the inner liner is threaded through a narrow opening in the wall of the outer liner and can be releaseably secured over a distinctive patch applied to the back of the outer garment. This structure is arranged to ensure that the indicator strip is clearly visible from the back of the coat. The problem with this structure is that it cannot be seen from the front or the side of the garment. In addition when a fireman wears a breathing apparatus the air supply tanks are usually carried on the back of the coat and they can obscure the distinctive patch.

U.S. Pat. No. 4,817,210 discloses a structure in which a flap is attached to the inner liner which is folded upwardly over a visible marking appearing on the lower edge of the back of the outer garment. Again this marking is only clearly visible from the back of the garment.

U.S. Pat. No. 4,768,233 discloses a fireman's garment in which detachable liners are provided for both the coat and the pants and the garments will not close properly unless the detachable liners are located within the outer shell. This is a complex structure requiring a complex arrangement of fasteners.

SUMMARY OF THE INVENTION

It is an object of the present invention to provide a simple and inexpensive means of indicating that a liner is operably positioned within an outer shell of a fireman's coat.

It is a further object of the present invention to attach the pocket flaps of a fireman's coat to the inner liner and to extend the flaps through narrow slots formed immediately above the opening in the pockets of the outer coat portion so that they can be extended downwardly to obscure visual indicators on the outer surface of the coat which are arranged in close proximity to the open ends of the pockets.

According to one aspect of the present invention, there is provided in a fireman's coat of the type which has an outer coat portion that forms an outer shell and an inner coat portion that forms a detachable liner for the outer shell, the outer coat portion having a side pocket formed in opposite sides thereof, each side pocket having an open end that extends in a front to back direction, the improvement of visible indicator means on each side of the outer coat in close proximity to the open end of each pocket, said indicator means extending in a front to back direction and having a sufficient extent to be clearly visible from the front, back and sides of the outer coat when the coat is worn by a fireman in use, a narrow opening formed in each side of the outer coat in close proximity to the open end of the pocket which is formed therein such that a narrow opening is associated with each pocket, a pocket flap attached to each side of the inner coat portion, each pocket flap being arranged so that it can extend through one of the narrow openings formed in the sides of the outer coat, attachment means for securing each pocket flap in an outwardly overlying relationship with respect to the outer coat to close the open end of its associated pocket and to overlie and obscure the visible indicator means associated therewith to clearly indicate that the liner is located in the outer shell in use.

Figure 1:
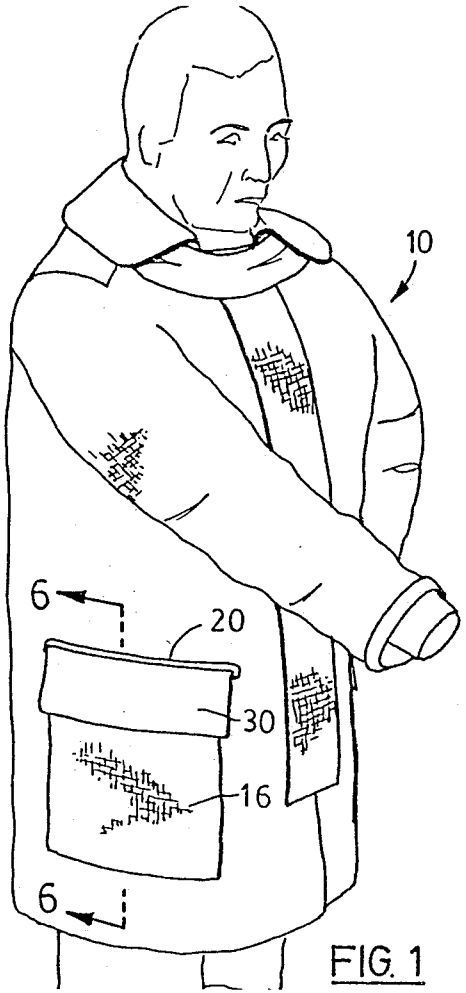
Figure 4:
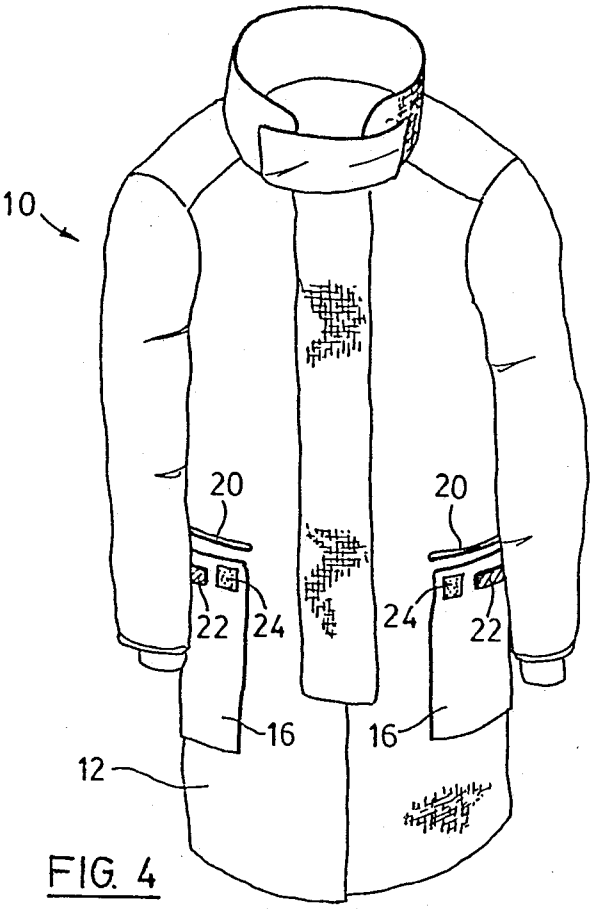
Figure 3:
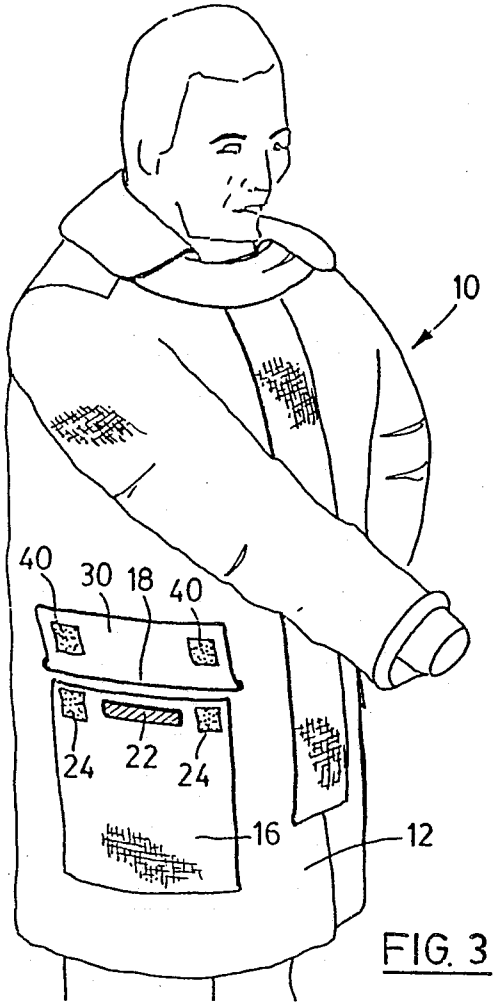
Figure 6:
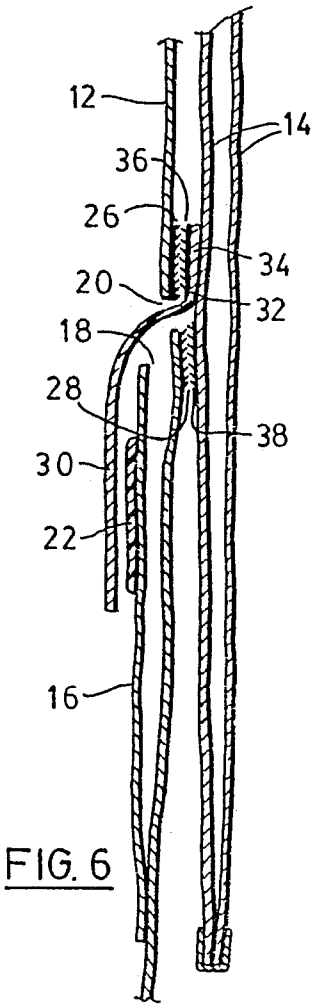
Figure 5:
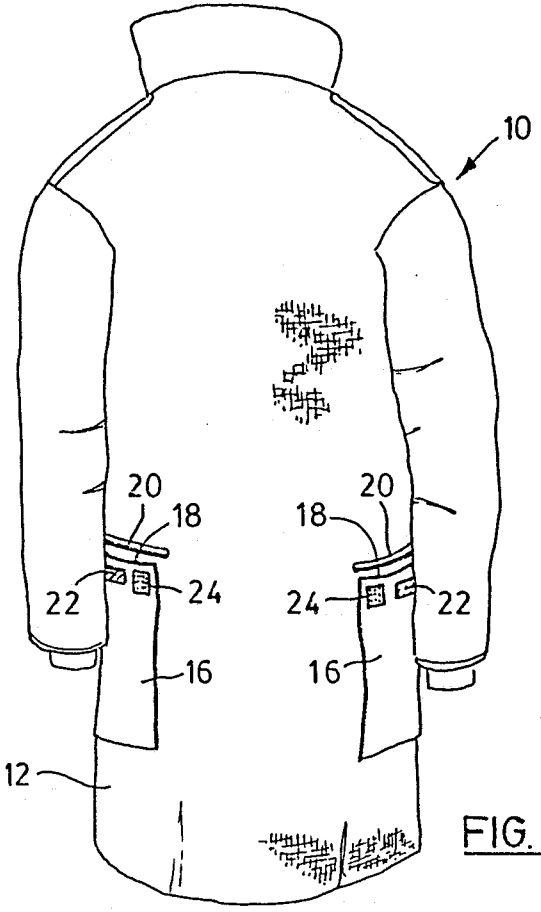

The invention will be more clearly understood with reference to the following detailed specification read in conjunction with the drawings wherein;

FIG. 1 is pictorial view showing the front and one side of a fireman's coat constructed in accordance with an embodiment of the present invention, FIG. 2 is a front view of the coat of FIG. 1 showing the manner in which the inner coat portion is located within the outer coat portion, FIG. 3 is a pictorial view similar to FIG. 1 showing the manner in which the pocket flap is extended through the outer coat, FIG. 4 is a front view of the outer coat portion indicating the manner in which the visible indicators are clearly visible from the front when the liner is not located in the outer coat portion, FIG. 5 is a back view of the outer coat portion of FIG. 4 showing the manner in which the visible indicators are visible from the back of the coat, FIG. 6 is a sectional view taken along the line 6–6 of FIG. 1.

With reference to FIG. 1 of the drawings, the reference numeral 10 refers generally to a fireman's coat constructed in accordance with an embodiment of the present invention. As shown in FIG. 2 of the drawings, the fireman's coat 10 comprises an outer coat portion 12 which forms an outer shell and an inner coat portion 14 that forms a detachable liner for the outer shell. This type of fireman's's coat construction is well known and will not therefore be described in detail.

Conventional patch pockets 16 are provided on opposite sides of the outer shell. As shown in FIG. 6 of the drawings, the pocket 16 has an open upper end 18. A narrow elongated opening 20 is formed at each side of the outer coat portion in close proximity to the open end 18 of the pocket. As clearly shown in FIGS. 3, 4 and 5 of the drawings, visible indicator patches 22 and 24 are secured to the outer face of the outer coat portion 12 and are located below the opening 18 in close proximity thereto. The patches 22 and 24 are made from a highly visible light-reflecting material which has a color that contrasts with the remainder of the coat. Generally, these patches are a bright orange color while the remainder of the coat is black with the usual additional reflective patches. The patches 24 are preferably made from one of the components of a hook and pile fabric fastener such as Velcro (trade-mark).

With reference to FIGS. 3, 4 and 5 of the drawings, it will be seen that the visible indicator patches 22 and 24 can be clearly seen when the coat is viewed from the front, back and side. For the purposes of illustration, the arm of the coat is shown in a raised position in FIG. 3, however it will be apparent that at least the patches 24 will be visible when the arm is in a normal vertical position.

As shown in FIG. 2 of the drawings, Velcro fastening strips 26 and 28 are applied to the inner face of the outer coat portion in close proximity to the narrow opening 20, the strip 26 being located above and the strip 28 being located below the narrow opening 20.

As shown in FIGS. 2 and 6 of the drawings, a pocket flap has a margin 34 (FIG. 6) which is attached to the inner coat portion 14 so as to permit the flap 30 to hinge about the hinge 32 between the raised position shown in FIGS. 2 and 3 and the lowered position shown in FIGS. 1 and 6. Velcro fastening strips 36 and 38 are located above and below the hinge 32 of the flap 30. Velcro patches 40 are located on the inner face of the pocket flap 30. It will be understood that a further flap 30 is attached to the other front panel of the inner coat portion 14 in a manner identical to that shown in FIG. 2.

In use, when the inner coat portion 14 is located within the outer coat portion 12, the pocket flaps 30 are threaded through the narrow openings 20 and the Velcro strips 36 and 38 are secured to the Velcro strips 26 and 28 respectively as shown in FIG. 6 to secure the inner garment with respect to the outer garment in close proximity to the openings 20 such that the pocket flap cannot readily be withdrawn as a result of relative movement between the inner coat portion and the outer coat portion. When the flaps 30 are located so that they extend through the openings 20, they may be hinged from the raised position shown in FIG. 3 to the lowered position shown in FIGS. 1 and 6. When in the lowered position shown in FIGS. 1 and 6, the Velcro patches 40 will be releaseably secured to the Velcro patches 24 and will serve to retain the flaps 30 in the lowered position. When in the lowered position, the flaps 30 obscure the visual indicator patches 22 and 24. When the inner liner is located in an operable position in the outer lining it is possible to obscure the visible indicator patches with a result that it is possible to determine that the liner is properly installed. On the other hand, when the inner liner is not properly installed, it is not possible to obscure the view of the visible indicator patches 22 and 24 which as previously indicated and as shown in FIGS. 3, 4 and 5 of the drawings may be clearly seen from the front, back and side of the coat.

From the foregoing, it will be apparent that the present invention provides a simple and inexpensive structure which serves to provide a clearly visible indication from the front, back and side of the coat when the inner liner is not operably located in the outer shell.

We claim:

1. In a fireman's coat of the type which has an outer coat portion that forms an outer shell and an inner coat portion that forms a detachable liner for the outer shell, the outer coat portion having side pockets formed in opposite sides thereof, each side pocket having an open end that extends in a front to back direction, the improvement of;

(a) visible indicator means on each side of the outer coat in close proximity to the open end of each pocket, said indicator means extending in a front to back direction and having a sufficient extent to be clearly visible from the front, back and sides of the outer coat when the coat is worn by a fireman in use, (b) a narrow opening formed in each side of the outer coat in close proximity to the open end of the pocket which is formed therein such that a narrow opening is associated with each pocket, (c) a pocket flap attached to each side of the inner coat portion, each pocket flap being arranged so that it can extend through one of the narrow openings formed in the sides of the outer coat, (d) attachment means for securing each pocket flap in an outwardly overlying relationship with respect to the outer coat to close the open end of its associated pocket and to overlie and obscure the visible indicator means associated therewith to clearly indicate that the liner is located in the outer shell in use.

2. A fireman's coat as claimed in claim 1, wherein the outer coat and inner coat each have an outer face and an inner face, complementary attachment means on the inner face of the outer coat and the outer face of the inner coat, the attachment means of the outer coat being located in close proximity to each narrow opening and the attachment means of the inner coat being located in close proximity to the pocket flap and serving to secure the inner coat to the outer coat and retain the pocket flaps in a position in which they extend through the narrow openings in use.

3. A fireman's coat as claimed in claim 1, wherein the visible indicator means is located directly below each narrow opening.

* * * * *